US009279249B2

(12) United States Patent
Surowiecki et al.

(10) Patent No.: US 9,279,249 B2
(45) Date of Patent: Mar. 8, 2016

(54) CORNER STUDS AND MANUFACTURING METHOD

(75) Inventors: Matt F. Surowiecki, Seattle, WA (US); Tadeusz (Ted) Wrobel, Auburn, WA (US); Lawrence W. Gorham, Vancouver, WA (US)

(73) Assignee: Steeler, Inc., Seattle, WA (US)

( * ) Notice: Subject to any disclaimer, the term of this patent is extended or adjusted under 35 U.S.C. 154(b) by 1158 days.

(21) Appl. No.: 13/092,055

(22) Filed: Apr. 21, 2011

(65) Prior Publication Data

US 2011/0239567 A1 Oct. 6, 2011

Related U.S. Application Data

(60) Division of application No. 11/605,088, filed on Nov. 27, 2006, now abandoned, which is a continuation-in-part of application No. 11/451,185, filed on Jun. 12, 2006, now abandoned.

(51) Int. Cl.

| | |
|---|---|
| ***E04B 2/58*** | (2006.01) |
| ***E04B 2/74*** | (2006.01) |
| ***E04B 2/78*** | (2006.01) |
| *E04B 2/72* | (2006.01) |

(52) U.S. Cl.

CPC ..... *E04B 2/7457* (2013.01); *E04B 2/789* (2013.01); *E04B 2/7854* (2013.01); *E04B 2002/725* (2013.01)

(58) Field of Classification Search

CPC ..... E04B 2/60; E04B 2/707; E04B 2/744; E04B 2/7425; E04B 1/6129; E04B 2/7457; E04B 2/789; E04B 2/7854; E06B 3/267; B21D 53/74

USPC ..... 29/897.3, 897.31, 897.312, 897.33, 29/897.35; 52/272, 280, 281, 52/282.1–282.4, 481.1

See application file for complete search history.

(56) References Cited

U.S. PATENT DOCUMENTS

| | | | | | |
|---|---|---|---|---|---|
| 2,028,554 | A * | 1/1936 | Main | ..... | 52/377 |
| 2,103,407 | A * | 12/1937 | Dean | ..... | 52/408 |
| 3,623,287 | A * | 11/1971 | Force | ..... | 52/280 |
| 6,609,344 | B2 * | 8/2003 | Saldana | ..... | 52/696 |
| 7,607,269 | B2 * | 10/2009 | Klein | ..... | 52/281 |

* cited by examiner

*Primary Examiner* — Ryan J Walters
(74) *Attorney, Agent, or Firm* — Bruce A. Kaser

(57) ABSTRACT

A corner stud (50) has intersecting first and second walls (52, 54) that back up corner edge portions of wallboard panels (40, 42) that meet at the inside corner. The walls (52, 54) are braced by walls (64, 70) and flanges (76, 78). Wall (52) and wall (70) may be parallel to each other and to flange (76). Wall (54) and wall (64) may be parallel to each other and flange (78). The stud (50, 52, 200, 202) may have a web bent about a longitudinal axis to form web parts separated by an inside angle (a). The angle a may be an obtuse angle below one hundred eighty degrees (180°) to about two hundred seventy degrees (270°).

1 Claim, 5 Drawing Sheets

FIG.1
PRIOR ART
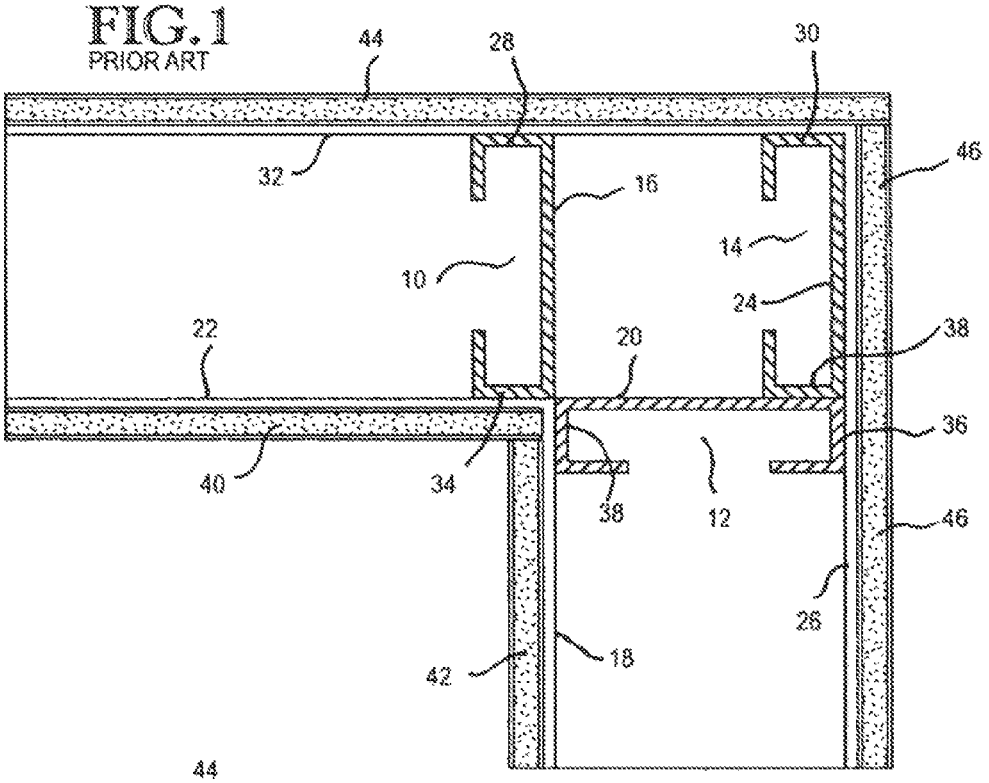
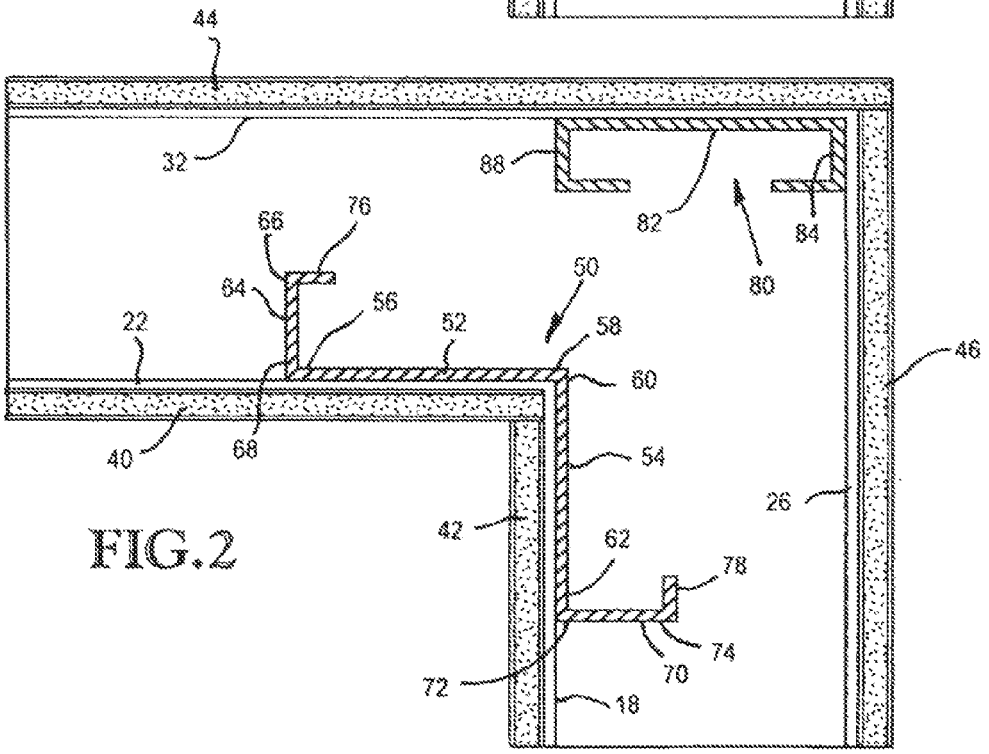
FIG.2

FIG.5
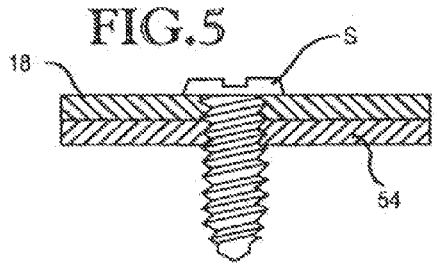
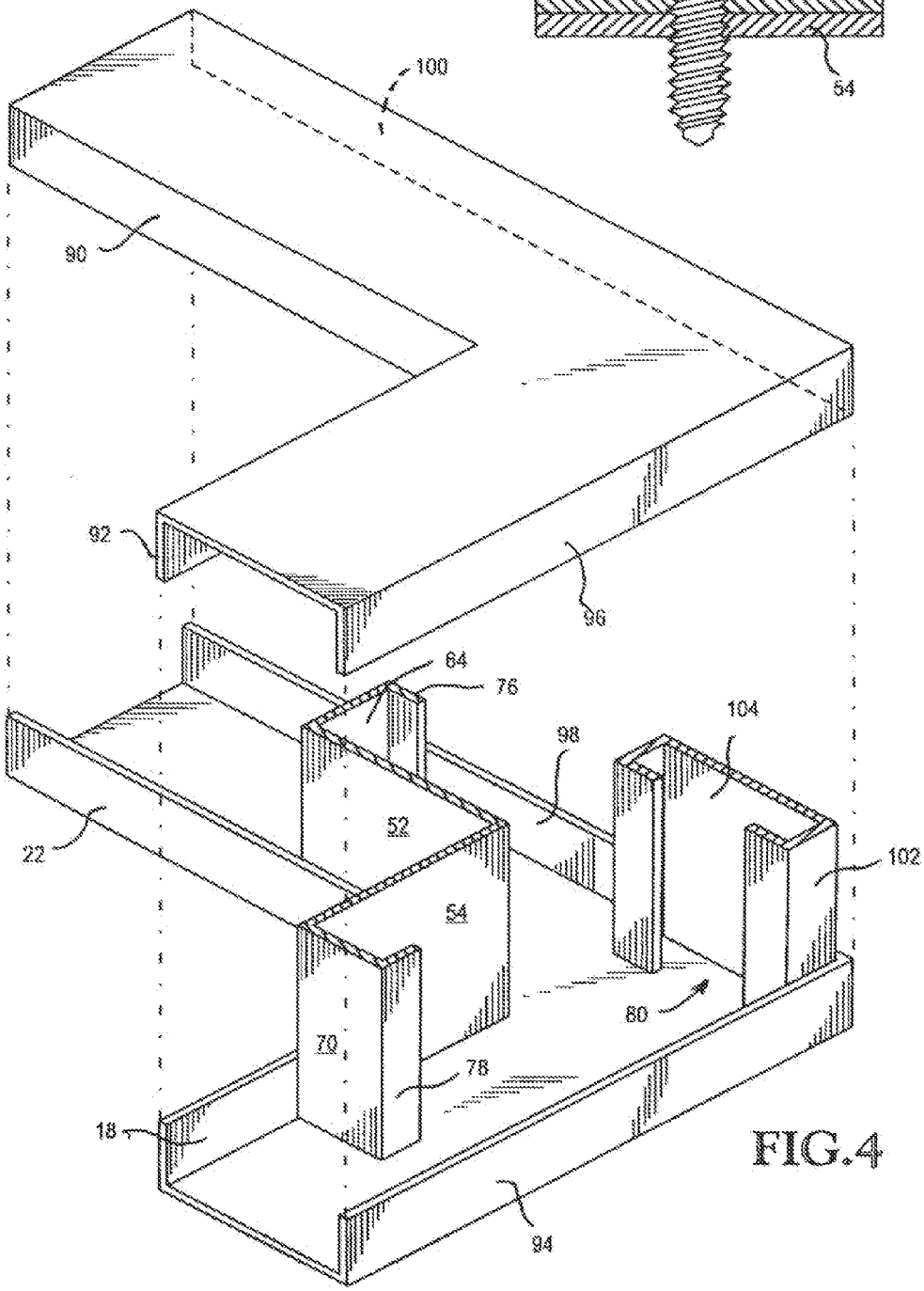
FIG.4

CORNER STUDS AND MANUFACTURING METHOD

RELATED APPLICATION

This application is a divisional of U.S. application Ser. No. 11/605,088, which is a continuation-in-part of U.S. application Ser. No. 11/451,185, filed Jun. 12, 2006 and entitled SHEET METAL INTERSECTION STUDS.

TECHNICAL FIELD

This invention relates to sheet metal framing walls. More particularly, it relates to the provision of studs usable where two walls intersect, for facilitating the connection together of the two walls.

BACKGROUND OF THE INVENTION

Building framing walls intersect each other at corners. These walls include upper and lower horizontal tracks and vertical studs extending between the tracks. FIG. 1 of the drawing herein shows a prior art use of three standard studs where two walls intersect at a corner. There is a need for solid back up for the edge portions of wallboard panels where they meet a corner of a wall. Solid back up is not adequately provided by the prior art arrangement of conventional studs.

There is a need for an inside corner stud that can be easily and quickly installed into upper and lower track corners. There is also a need for an inside corner stud that provides substantial backing for the edge portions of the wallboard panels that meet at the inside corner white saving costs. It is the primary object of the present invention to fill these needs.

In building construction, not all walls intersect each other at ninety degrees (90°). Some walls intersect at an angle that is larger than ninety degrees (90°) and less than one hundred and eighty (180°). A common intersection angle is one hundred and thirty-five degrees (135°). There is a need for corner studs that can be used at these corners. Another object of the present invention is to fill this need.

BRIEF SUMMARY OF THE INVENTION

It is an object of the invention to provide an elongated one-piece sheet metal corner stud having first and second perpendicular walls that meet at the inside corner. Upper end portions of these walls are connected to flanges on a corner portion of an upper track. Lower end portions of these walls are connected to flanges that are on a corner portion of a lower track.

In preferred form, the corner stud includes a third wall that is connected to the first wall and a fourth wall is connected to the second wall. The first and fourth walls are parallel to each other and perpendicular to the second and third walls. The second and third walls are parallel to each other and perpendicular to the fourth wall. Preferably, the third wall includes a flange that is perpendicular to the second and third walls and is parallel to the first and fourth walls. Preferably also, the fourth wall is provided with a flange that is parallel to the second and third walls and perpendicular to the first and fourth walls and the first flange.

The upper end of the inside corner stud fits inside of a corner portion of an upper track and the lower end of the inside corner stud fits inside of a corner portion of a lower track. The flanges of the tracks are secured to the first and second walls of the stud by the use of sheet metal screws.

In a preferred corner assembly, a stud that may be a conventional sheet metal stud is provided at the outside corner of the wall. The flanges of the upper and lower tracks are secured to the webs and one flange of this stud.

It is a further object of the invention to provide a channel shaped corner stud having a web that is bent about a longitudinal axis into first and second parts, each part including a sidewall at its outer edge that extends perpendicular to its part and a flange at the outer end of the wall that extends perpendicular to the wall. This construction gives the stud the shape of a lipped channel having a web that is bent about a longitudinal axis. The angle between the two web parts on the channel side of the stud may vary substantially. A common angle will be one hundred and thirty-five degrees (135°) for a stud that is used at the outside corner. Another common angle is two hundred and seventy degrees (270°) for a stud that is used at the inside wall. Walls that meet at an angle other than ninety degrees (90°) will have upper and lower track portions at the corner which have the same angular relationship as the wall of which they are apart.

Other objects, advantages and features of the invention will become apparent from the description of the best mode set forth below, from the drawings, from the claims and from the principles that are embodied in the specific structures that are illustrated and described.

BRIEF DESCRIPTION OF THE SEVERAL VIEWS OF THE DRAWINGS

Like reference numerals are used to designate like parts throughout the several views of the drawing, and:

For background purposes,

FIG. 1 shows a prior art arrangement of prior art studs at a corner formed by intersecting framing walls, such view showing corner studs in cross section, lower track components in plan and inside and outside wallboard members in section.

FIG. 2 is a view at the same corner as FIG. 1, but showing an side corner stud constructing according to present invention and its arrangement with a conventional stud at the outside corner;

FIG. 4 is a view like FIG. 3, but showing a fragmentary portion of the inside corner stud and the outside corner stud in the same arrangement as FIG. 2, and where two walls meet.

FIG. 5 is a view showing a screw connection between two sheet metal members;

DETAILED DESCRIPTION OF THE ILLUSTRATED EMBODIMENT

Figure 3:
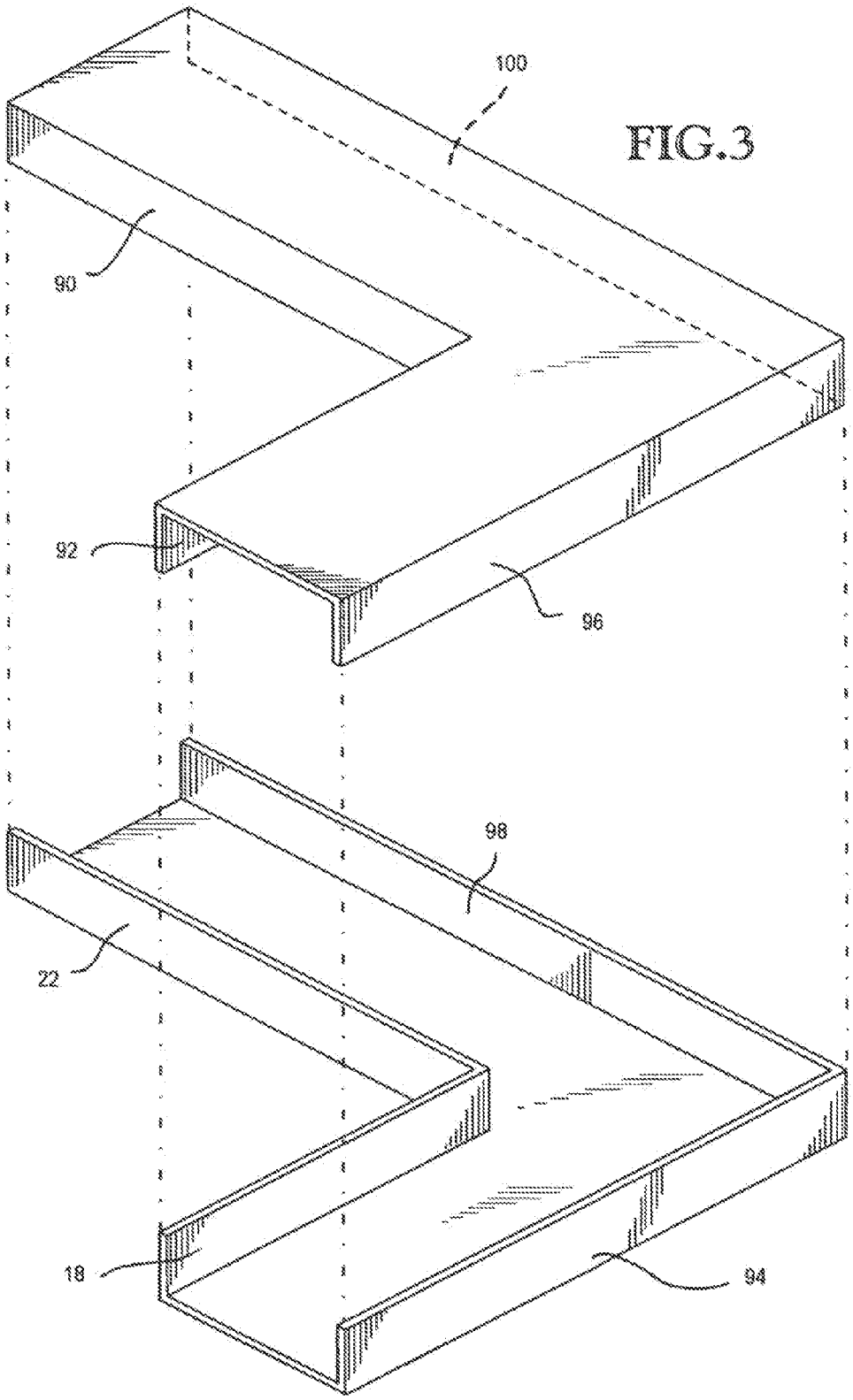
FIG. 3 shows upper and lower corner components for the upper and lower tracks spaced from each other and confronting each other.

In FIG. 1, three conventional studs 10, 12, 14 are shown at a corner. The lower ends of the studs 10, 12, 14 are inside a lower track at its corner. Stud 10 has a web 16 that is substantially co-planar with track flange 18. Stud 12 has a web 20 that is substantially co-planar with web flange 22. Stud 14 has a web 24 that is situated inside adjacent track flange 26. Studs 10, 14 have flanges 28, 30 that are inside adjacent track flange 32. Stud 10 has a flange 34 that is inside adjacent track flange 22. Stud 12 has a flange 36 that is adjacent track flange 26 and a flange 38 that is adjacent track flange 18. Stud 14 has a flange 38 that is adjacent stud web 20. Stud web 24 and stud flange 36 are substantially co-planar and are both inside adjacent track flange 26. At the inside of the corner, wallboard panels 40, 42 are backed up by stud flanges 34, 38 respectively. At the outside corner, wallboard panel 40 is backed by stud flanges 28, 30 and wallboard panel 46 is backed up by stud web 24 and stud flange 36. As will be appreciated, the upper ends of the studs 10, 12, 14 fit into the upper track corner in essentially the same way as illustrated in FIG. 1.

FIGS. 2 and 4 show an inside corner stud 50 having a first wall 52 that backs up wallboard panel 40 and a second wall 54 that backs up wallboard panel 42. First wall 52 has a first edge 56 and a second edge 58. Second wall 54 has a first edge 60 and a second edge 62. The second edge 58 of first wall 52 is connected to the first edge 60 of second wall 54. A third wall 64 has a first edge 66 and a second edge 68. Edge 68 of wall 64 is connected to edge 56 of wall 52. A fourth wall 70 has a first edge 72 and a second edge 74. Edge 62 of wall 54 is connected to edge 72 of wall 70. A first flange 76 is connected to the first edge of third wall 64. A second flange 78 is connected to the second edge 74 of fourth wall 70. Flange 76 and walls 52, 70 are parallel to each other and perpendicular to walls 54, 64 and flange 78.

The upper and lower ends of inside corner stud 50 are received in the inside corner portions of upper and lower track corner components.

Inside corner stud 50 may be used by itself as shown by FIGS. 2 and 4, or it may be used together with a conventional stud 80 that is at the outside corner, positioned with its web backing up one of the wallboard panels 44, 46 and a flange backing up the other. In FIGS. 2 and 4, the stud web 82 is shown to be adjacent the track flange 32 and the stud flange 84 is shown to be adjacent the track flange 26. Alternatively, the stud 80 may be turned 90. degree. so that its web 82 contacts track flange 26 and its flange 88 contacts track flange 32.

FIG. 4 shows that the upper ends of the studs 50, 84 fit upwardly into the upper corner track component just like the lower end portions fit within the lower corner track component.

The inside corner stud 50 is strong and provides a wide and solid backup for the wallboard panels 40, 42 where they meet at the inside corner. The upper and lower flanges 90, 92 and 22, 18 can be easily and quickly connected to the stud walls 52, 54 by screw fasteners. When screw fasteners are used to secure the intersecting end portions of the wallboard panels 40, 42 to the stud walls 52, 54, a solid connection is provided at the inside corner for the corner track components, the inside corner stud and the wallboard panels 40, 42.

The outside corner stud 80 can also be easily and quickly installed. Its upper and lower ends are fitted into the outside corner portions of the two corner track components. Screw fasteners are inserted through the track flanges 94, 96 and are screwed into the outside corner stud flange 102. In similar fashion, screw fasteners are inserted through flanges 98, 100 of the corner track components and are screwed into the stud web 104. Thus, the ends of the outside corner stud 80 are firmly connected to the track flanges 94, 98 and 96, 100 and then the wallboard panels 44, 46 are firmly attached to the corner stud web 104 and the corner stud flange 102.

FIG. 5 shows a sheet metal screw extending through a track flange and either a stud flange or web. This screw may be a conventional sheet metal screw or it may be a sheet metal screw having a flatter head than conventional sheet metal screws. The FIG. 5 showing of a screw connection is typical of a screw connection that can be used at each location where a track flange is connected to a stud flange or web, or a wallboard panel is connected to a sheet metal member.

Figure 7:
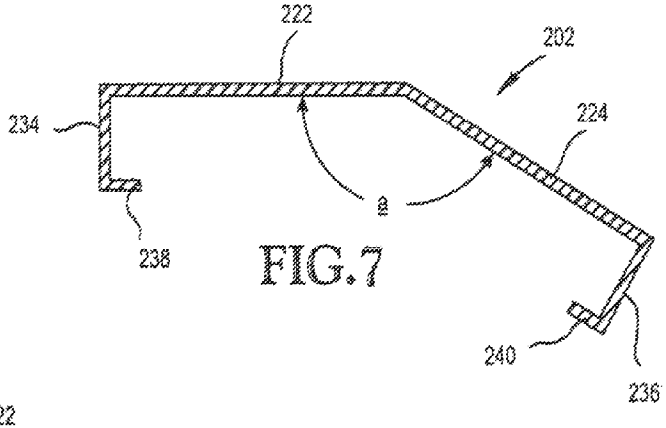
FIG. 7 is a view like FIG. 6, but showing an outside corner stud for the same wall.
Figure 6:
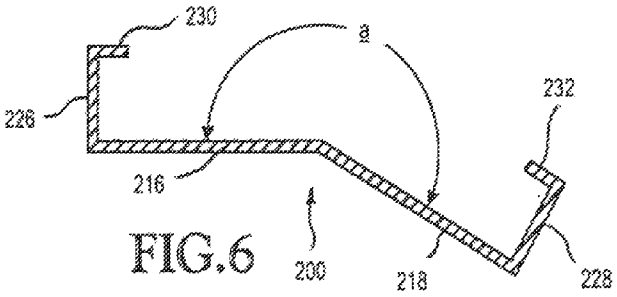
FIG. 6 is an end view of an inside corner stud for a corner formed by two walls that intersect at a diagonal.
Figure 8:
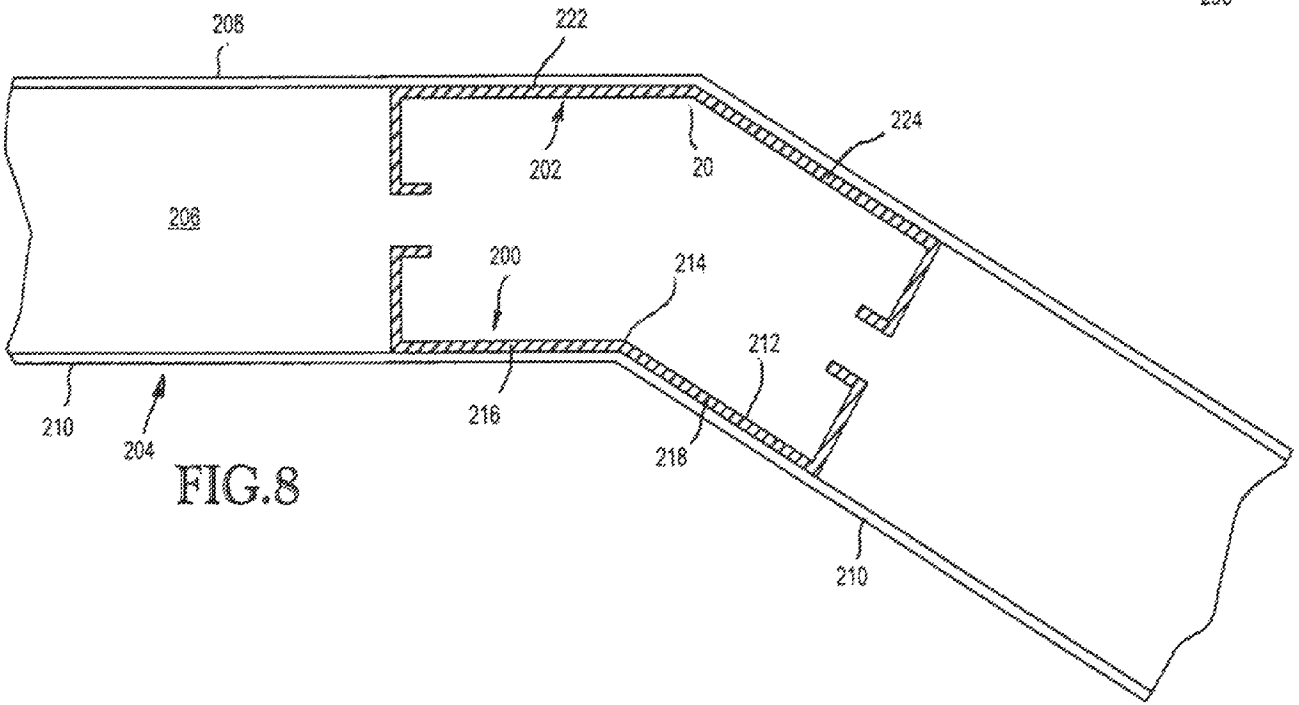
FIG. 8 is a view like FIG. 2, but of a diagonal corner and showing the use of the studs that are shown by FIGS. 6 and 7.

FIG. 6 shows an inside corner stud 200 for a diagonal corner and FIG. 7 shows an outside corner stud 202 for the same corner. FIG. 8 shows the studs 200, 202 installed at the intersection of two wall sections of a diagonal wall. Specifically, the corner studs 200, 202 are shown with their lower ends inside of a channel shape lower track 204 having a web 206 and flanges 208, 210 that intersect at the corner. The top track (not shown) is a mirror image of the lower track 206. The upper ends of the corner studs 200, 202 extend into the upper track in essentially the same manner as shown in FIG. 8. The corner stud 200 includes a web 212 that is bent about a longitudinal axis 214 into two web parts 216, 218. Web parts 216, 218 lie against the flange 210 on the inside of the track. In similar fashion, outside corner stud 200 is bent along a longitudinal axis 220 into first and second web parts 222, 224. As shown by FIG. 8, the end portions of the corner stud 202 fit within the corner with the web parts 222, 224 against the track flange 208. For reinforcement purposes, corner stud 200 includes sidewalls 226, 228 which extend perpendicular to the web parts 216, 218. Sidewalls 226, 228 include flanges 230, 232 that extend perpendicular to the sidewalls 226, 228. Corner stud 206 has a similar construction. Sidewalls 234, 236 extend perpendicular from the web parts 222, 224. Flanges 238, 240 extend at a perpendicular from the sidewalls 234.

Figure 9:
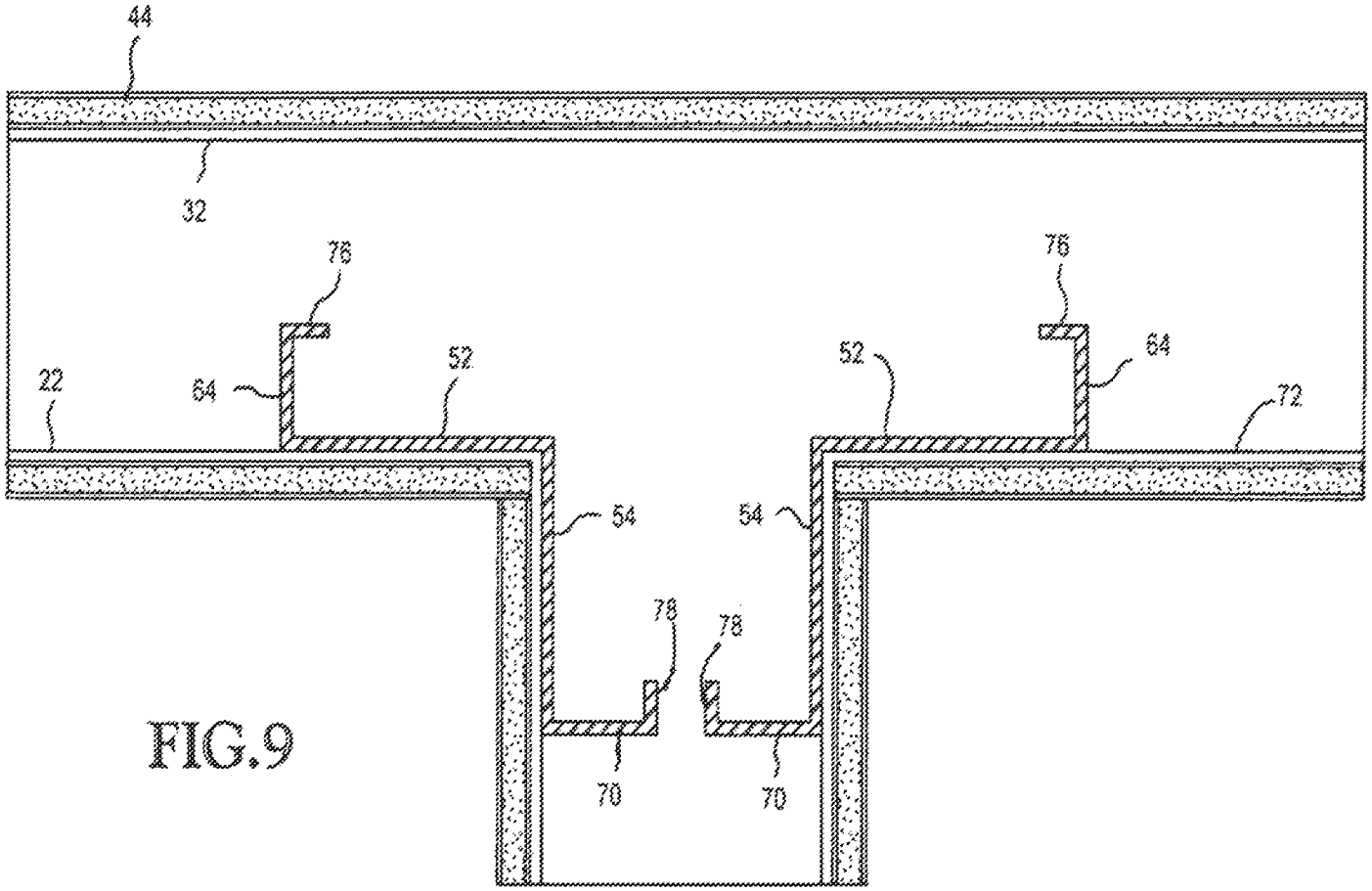
FIG. 9 is a view like FIG. 8, but showing an intersection of walls between two corners, showing the use at the intersection of two inside corner studs such as shown by FIGS. 2 and 4.

FIG. 9 shows the use of two inside corner studs 50 where a perpendicular wall intersection a mid portion of a long straight wall.

Corner studs 50, 200, 202 are similar to common studs, the difference being the dimensions of the studs and the size of the angle a between the web parts 52, 54, web parts 216, 218 and web parts 222, 224. The angle between the channel side faces of the web parts 52, 54 of stud 50 is ninety degrees (90°). For corner stud 200, the angle a is two hundred and ten degrees (210°). For corner stud 202, the angle a is one hundred and fifty degrees (150°). As can be seen, the angle a will vary in accordance with the intersection angle of the two walls of the corner. The design of the building establishes at what angle the two walls will meet and that angle is used to compute the value of angle a for each of the corner studs 200, 202.

Preferably, the web, sidewall and flange portions of the studs 50, 200, 202 are manufactured by use of a standard roll forming process. This process results in the rolled stud having a flat web, sidewalls extending perpendicular to the edges of the web, and flanges extending perpendicular to the edges of the sidewalls. According to a method aspect of the invention, the rolled stud is then bent around a longitudinal center line until the two web parts are separated from each other by the desired angle a. This bending may be done by a common process known as "breaking." One half of the web is held by a member that includes a longitudinal outside edge. The second half is then bent around the outside edge.

The illustrated embodiments are only examples of the present invention and, therefore, are non-limitive. It is to be understood that many changes in the particular structure, materials and features of the invention may be made without departing from the spirit and scope of the invention. Therefore, it is my intention that my patent rights not be limited by the particular embodiments that are illustrated and described herein, but rather are to be determined by the following claims, interpreted according to accepted doctrines of patent claim interpretation, including use of the doctrine of equivalents.

What is claimed is:

1. A corner stud assembly in a framing wall, comprising:

an upper horizontal track forming an inside corner;

a lower horizontal track forming an inside corner below the inside corner formed by the upper track;

said upper horizontal track having perpendicular flanges at the upper inside corner;

said lower horizontal track having perpendicular flanges at the lower inside corner formed by the lower track; and an elongated sheet metal, inside corner stud, vertically extending between said lower track and said upper track, comprising:

a first wall;

a second wall;

a third wall;

a fourth wall;

said first wall having a first edge and a second edge;

said second wall having a first edge and a second edge;

said third wall having a first edge and a second edge;

said fourth wall having a first edge and a second edge;

said second edge of said first wall being connected to the first edge of the second wall;

said second edge of the third wall being connected to the first edge of the first wall;

said second edge of the second wall being connected to the first edge of the fourth wall;

said first wall being perpendicular to the second wall and the third wall, and parallel to the fourth wall;

said second wall being perpendicular to the first wall and the fourth wall, and parallel to the third wall; and said first and second walls forming an inside corner that is inwardly adjacent to the flanges at the inside corners of the upper and lower tracks, and is adapted to provide a backing for wallboard edges that meet at the inside corner;

an elongated sheet metal, outside corner stud, vertically extending between said lower track and said upper track, comprising:

a vertical stud web;

a first vertical stud flange;

a second vertical flange;

said first and second vertical stud flanges being connected to said vertical stud web; wherein said outside corner stud is spaced apart from said inside corner stud to provide a passageway space between said outside and inside corner studs, with said vertical stud web being substantially parallel to said first wall of said inside corner stud; and wherein the inside corner stud comprises a first flange connected to the first edge of the third wall and a second flange connected to the second edge of the fourth wall; and the first flange, connected to the third wall, is perpendicular to the third wall and the second flange, connected to the forth wall, is perpendicular to the fourth wall.

* * * * *